United States Patent [19]

Pavlik

[11] Patent Number: 4,872,222

[45] Date of Patent: Oct. 10, 1989

[54] TOILET-TANK LEAK DETECTOR, CHEMICAL ECONOMIZER

[76] Inventor: Jonn P. Pavlik, 20411 Lassen St., Chatsworth, Calif. 91311

[21] Appl. No.: 225,461

[22] Filed: Jul. 27, 1988

[51] Int. Cl.[4] ..... E03D 9/02

[52] U.S. Cl. ..... 4/228; 4/227; 422/266; 222/181

[58] Field of Search ..... 4/222, 223, 227, 228, 4/231, 490, 496; 422/266, 265, 264, 261, 263, 276; 222/181, 160, 163, 180; 134/93; 68/17 R; 210/198.1; 73/40.7

[56] References Cited

U.S. PATENT DOCUMENTS

| | | | |
|---|---|---|---|
| 1,260,180 | 3/1918 | Gallagher | 4/227 |
| 1,351,273 | 8/1920 | Wood | 422/266 |
| 3,846,078 | 11/1974 | Brett | 422/265 |
| 3,953,902 | 5/1976 | Taylor | 4/227 |
| 4,420,463 | 12/1983 | Pocivs et al. | 422/266 |
| 4,455,692 | 6/1984 | Hegge et al. | 4/228 |

FOREIGN PATENT DOCUMENTS

| | | | |
|---|---|---|---|
| 0241344 | 10/1925 | United Kingdom | 4/231 |
| 0352578 | 7/1931 | United Kingdom | 4/227 |

*Primary Examiner*—Henry J. Recla

*Assistant Examiner*—J. Casimer Jacyna

[57] ABSTRACT

A manually controlled device by which a body of water coloring toilet bowl cleanser can be held in either a lower position in the water of a toilet flush tank or a raised position above the water without moving the tank lid so that the bowl cleanser can be saved when its action is not desired. A leak in the flush valve or loss of water past the overflow pipe can be easily detected by introducing the water coloring toilet bowl cleanser into a clear tank with clear water in the toilet bowl, then not flushing the toilet for several hours thereafter. Since the water in the tank now becomes colored, any appearance of color in the toilet bowl will indicate a leak past the flush valve or the overflow pipe, or both. This out-of-tank control of the position of the toilet bowl cleanser into and out of the tank is accomplished by providing for the free passage of a strong, fine line, like a fishing line, over the rim of a toilet tank when the lid is in place, then attaching to this line a body of water coloring toilet bowl cleanser within the tank and connecting to the end of the line on the exterior of the tank a handle that can be manually operated to move the line up or down and thus move the cleanser into or out of the tank water for as long as desired.

9 Claims, 2 Drawing Sheets

TOILET-TANK LEAK DETECTOR, CHEMICAL ECONOMIZER

BACKGROUND OF THE INVENTION

For toilet-bowl cleansing, aesthetic and water conservation (masking urine color) reasons, there is widespread use of a colored (usually blue) slow dissolving water coloring toilet bowl cleanser in a glass jar that is placed on the bottom of a toilet flush tank. There are many long periods of non-flushing as in week-end and summer homes; homes vacant during week-end and summer. Chemical placed in flush tank is messy once dissolution takes place; therefore, it is left to waste in the tank during these long periods of non-flushing. When its action is not needed or desired there is no convenient way to stop the dissolving action. This invention provides a simple means of optionally stopping and starting this water treatment process without lifting of the tank lid which is commonly a fully loaded platform for bathroom supplies and accessories. Because of the off and on control of this invention it is an excellent colorimetric detector of leaks past the flush valve and loss of water past the overflow pipe of a toilet flush tank. This device utilizes the fact that a fishing line is strong and of small diameter so that, when a toilet-tank lid is supported just enough to clear movement of the line across rim of a flush-tank, position of a loose body of chemical connected to the line within tank can be moved in and out of tank water by manipulation of the end of the line which is inside of the tank.

SUMMARY OF THE INVENTION

This invention comprises:

- a vessel carrier that can hold any, within a range of size, wide mouth vessel containing water color toilet bowl cleanser in upright position, said vessel carrier with a hook mounted in its top end,
- a rim saddle component made from sheet aluminum by cutting and bending into approximate shape of a saddle to fit snuggly over a toilet tank rim. The rim saddle made from sheet aluminum can be painted and alternately made of plastic which can be colored plastic. The top surface of this rim saddle is formed with high spots functioning to hold an installed tank lid above a fishing line moving freely across the saddle surface.

The out-of-tank member of the rim saddle is cut and bent so as to space the main portion of this member away from the tank wall and so as to create a void in the center of its lower end. Two spaced apart holes are drilled, equidistant from tank wall, in this out-of-tank member at its extreme low end and wire, bent in the form of a "broad U", is bent further to be inserted into these holes so as to form a lever rotating on a vertical plane and which can be printed. This lever and a fishing line attached at center of its cross-bar can be moved past bottom dead center, as defined by position of the holes, to be stopped by the tank wall and remain there as long as there is an upward pull on the line, which is a fishing line and chain. From its attachment to the lever, the line leads up and across the low area of the rim saddle top surface, down into the tank and is tied into end link of a chain that is then left to dangle. An appropriate link of the dangling chain is engaged by the hook mounted at the top of the vessel carrier so when the line and lever are stopped against tank wall, past bottom dead center, the mouth of the vessel held by vessel carrier is less than 1" above water.

This so comprised invention can be used for long periods of time without need to remove the tank lid. Operation of this device is by simply either pushing the lever down past bottom dead center where it will be held by the tank wall and pull of the line, which is holding the vessel mouth out of the water, or flipping it out past bottom dead center where it will be pulled up and held at approximate top dead center by the pull of the line which is holding the vessel in a submerged position.

Detection of wasted water is easily accomplished during a period of nontreatment of water, wherein water in both tank and bowl is clear, by flipping the lever up so that tank water becomes colored. During a subsequent period of non-flushing, if the water in toilet bowl becomes colored, there is a leak in flush valve or loss of water past overflow pipe of tank or both. Water loss detection is also easy during periods of water treatment wherein the water in both the tank and bowl is colored. The lever is pulled down to stopped position and the toilet is flushed. Clear water will now flow into the tank and be isolated from the coloring chemical in the raised vessel. During a subsequent period of non-flushing, if the residual colored water in the bowl becomes clear, a leak in flush valve or loss of water past overflow pipe of tank or both is indicated.

One object of this invention is to save water by detecting a leak in toilet-tank flush valve and loss of water past within-tank overflow pipe.

Another object of this invention is to save toilet-bowl treatment chemical by providing a simple, convenient method of optionally stopping or starting toilet-bowl chemical treatment process without need to lift tank lid.

Another object of this invention is to eliminate cost of disposable glass-plastic container that contains water coloring toilet bowl cleanser commonly used.

Another object of this invention is to eliminate the inconvenience of frequently removing tank lid, retrieving from tank bottom and disposing emptied glass-plastic container and then placing another, filled container, in its place.

A fuller understanding of the invention will be had by referring to the following description of a preferred embodiment thereof, taken in conjunction with the accompanying drawings wherein like reference characters refer to similar parts throughout the several views and in which:

DESCRIPTION OF THE PREFERRED EMBODIMENTS

Figure 1:
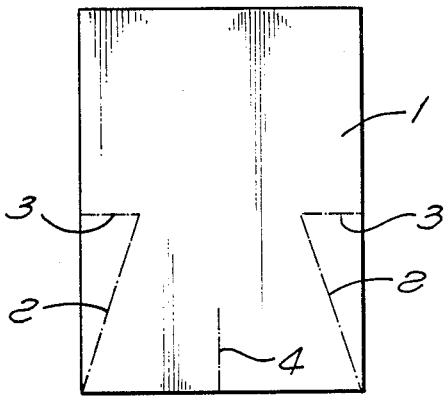
FIG. 1 is a top view showing a sheet of aluminum that will form the rim saddle component of this invention marked with lines indicating cuts to be made.
Figure 2:
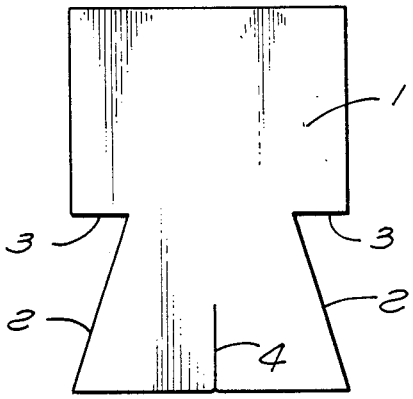
FIG. 2 is a top view of the aluminum sheet shown in FIG. 1 after cuts have been made as indicated in FIG. 1.
Figure 3:
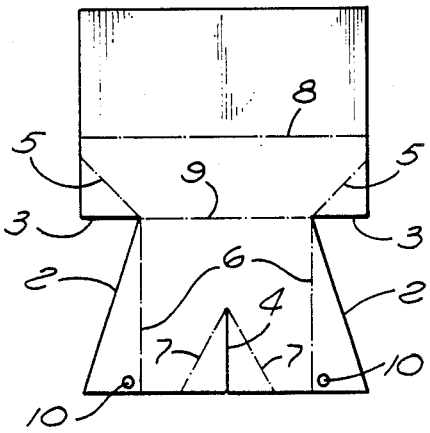
FIG. 3 is a top view of the cut aluminum sheet shown in FIG. 2 showing two drilled holes and lines along which bends are to be made.
Figure 4:
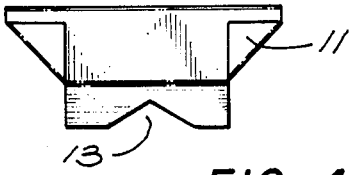
FIG. 4 is a top plan view showing results of bending cut sheet which was marked for bending in FIG. 3.
Figure 5:
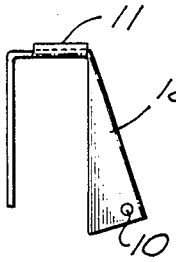
FIG. 5 is a side elevational view of the Fig. shown in FIG. 4, showing its saddle-like configuration.

For a better understanding of the present invention, reference is made to the following description taken in connection with the accompanying drawings, and its scope will be pointed out in the appended claims. A sheet of aluminum 1/32"×2½"×3¼", 1 of FIG. 1, is marked with two ⅝" lines, 3 of FIG. 1, running 1½" from and parallel to one of its 2½" sides and extending from each 3¼" side. Lines, 2 of FIG. 1, are drawn from inside ends of each of the ⅝" lines to their nearest corners, thus forming two slender triangles bilaterally. Between these two triangles, at the center of the 2½" side, a ¾" line, 4 of FIG. 1, is drawn perpendicular to the side. These marks, identified as 2,3 and 4 of FIG. 1, are lines on which cuts are made with tin snips so as to produce the form shown as FIG. 2. Guide-lines for bending are drawn as shown in FIG. 3. Marks are made ½" from each ⅝" "cut-line", 3 of FIG. 3, along remnant of each 3¼" side. Lines, 5 of FIG. 3, are drawn from each of these ½" marks to the inside ends of their proximate ⅝" "cut-line", 3 of FIG. 3. From the inside ends of these ⅝" "cut-lines" are drawn lines, 6 of FIG. 3, perpendicular to the nearest 2½" side. Spaced ⅜" on each side of the ¾" cut, 4 of FIG. 3, marks are made on the 2½" side and lines, 7 of FIG. 3, are drawn from those marks to the inside end of the ¾" cut. 2⅛" from and parallel to the 2½" side that now forms bases for several triangles a line, 8 of FIG. 3, is drawn. Within each triangle formed by "cut line" 2, drawn lines 6 and segements of the 2½" side, FIG. 3, a 3/32" hole, 10 of FIG. 3, is drilled ⅛" from line 6 and ⅛" from the segment of the 2½" side. Inside ends of "cut lines" 3 of FIG. 3 are connected by a drawn line to form line 9 of FIG. 3. Lines 5, 6, 7, 8 and 9 of FIG. 3 are bend lines and bends must be made in that numberal order. Lines 5, FIG. 3 are bent 180 degrees rotation to produce Tank-Lid Lifters shown as 11 of FIGS. 4, 5, 6, 7 and 12. Lines 6 are bent with 90 degrees rotation to form the bottom dead center spacer, 12 of FIGS. 5, 7 and 12. Lines 7 are bent with 90 degrees rotation to provide a triangular bottom dead center passage, 13 of FIGS. 4, 6 and 7 for line, 20 of FIGS. 6, 7 and 12. Line 8, FIG. 3, is bent with 90 degrees rotation and line 9, FIG. 3, is bent with approximately 65 degree rotation so that these two latter bends, 8 and 9, produce a saddle like form as shown in FIG. 5.

Figure 6:
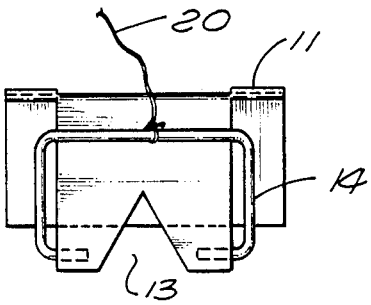
FIG. 6 is a front elevational view of the rim saddle component of this invention, shown in FIGS. 4 and 5, with "U" shaped lever component of this invention installed and line compoment tied to lever.
Figure 7:
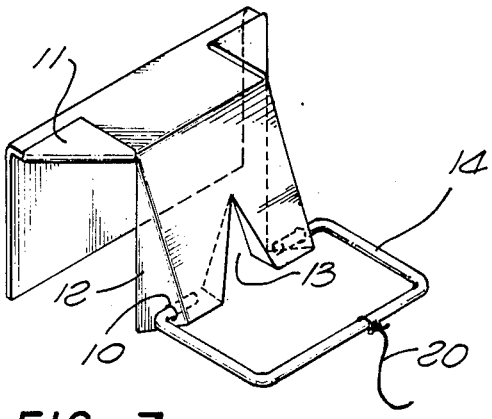
FIG. 7 is a perspective view view of the Rim Saddle shown in FIGS. 4, 5 and 6, with lever installed and line component tied to LEVER.
Figure 12:
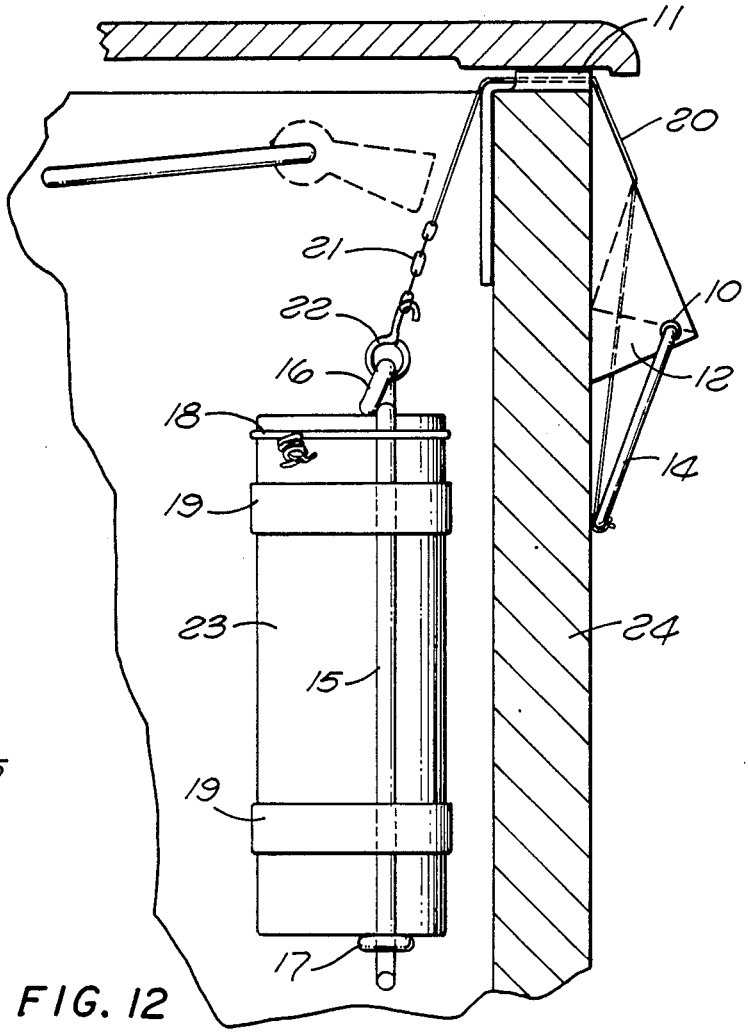
FIG. 12 is a side elevational view of this invention showing all parts detailed in FIGS. 1–11 assembled into the complete invention and functionally disposed on rim of toilet-tank which is in fragmented, breakaway sectional view.

A 4" length of stainless steel 16 gauge wire is bent into a "broad U" shape, 14 of FIGS. 6 and 7, to form a lever in which the arms are 1¼" long and the cross member measures 1½". A length of ¼" of each end of the arms is bent toward the other until these ¼" lengths are parallel to the 1½" cross member, 14 of FIG. 6. The arms are pressed toward each other so that they become converged slightly and the lever is snapped into place into the holes shown as 10 in FIGS. 7 and 12. One end of a 15-pound-test fishing line, 20 of FIGS. 6, 7 and 12 is tied to the center of the cross member of the lever, 14 of FIGS. 6, 7 and 12 and its other end is tied to end link of a stainless steel chain of approximately ⅛" length links, 21 of FIG. 12, so that there is between 4 and 4½" of line connecting the lever and the chain. The saddle-like rim saddle, formed by cutting and bending the aluminum sheet, 1 of FIG. 1, according to FIGS. 2 and 3, with lever installed, fishing line attached to lever and chain, is now set astraddle the rim of a toilet flush tank with the lever on the outside as shown in FIG. 12.

Figure 8:
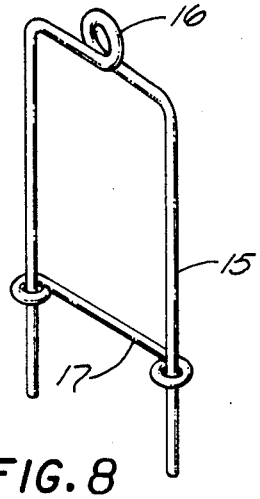
FIG. 8 is a perspective view of the frame and hook components of the vessel carrier component of this invention.

A 15" length of 12 gauge, plastic covered copper wire, 15 of FIG. 8, is formed into a written letter small e (e) at its mid-length to form a loop of approximately 3/16" internal diameter. Equidistant, approximately 1", from center of the loop and on the same plane as the loop bend, right angle bends are made away from the loop so that the loop, 16, is sitting atop the mid-section of the cross member of a slender inverted "U", 15 of FIG. 8. A 4" length of the same type 12 gauge plastic covered wire is formed into loops, 17 of FIGS. 8, 9, 11, 12, at each end and each loop is slipped over one leg of the inverted "U" formed wire, 15 of FIG. 8, to form a connector-spacer for the legs of the "U" that is moveable up the legs and can be locked from dropping by bending the legs at the point where they emerge below the loops. A 2" length of 16 gauge stainless steel wire is bent into shape of a fishing hook with a big eye, 22, and is mounted in loop, 16 of FIGS. 8, 9, 10, 12.

Figure 9:
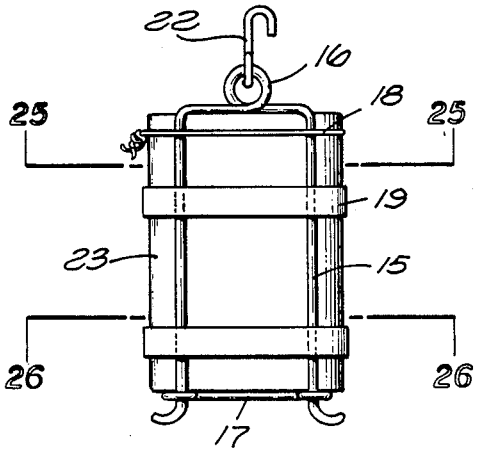
FIG. 9 is a rear elevational view of the complete vessel carrier component of this invention shown holding a vessel.
Figure 10:
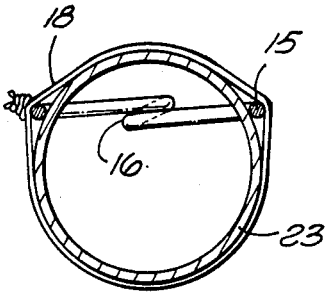
FIG. 10 is a transverse sectional view taken upon the plane of the section line 25—25.
Figure 11:
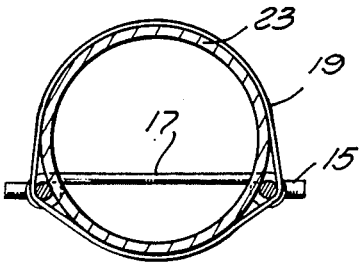
FIG. 11 is a transverse sectional view taken upon the plane of the section line 26—26.

As shown in FIG. 9, 2 large rubber bands, 19, and 14" length of 16 gauge plastic covered copper wire, 18, are added to the inverted "U" formed wire, 15; loop, 16; spacer-connector, 17, and hook 22 to make up a complete vessel carrier shown holding a vessel, 23.

Any vessel, 23 of FIGS. 9, 10, 11, 12, between 2" and 3½" in diameter and less than 5" in height can be securely mounted on this vessel carrier, FIGS. 9 and 12, by setting cross member of inverted "U", 15, with its loop, 16, and hook, 22, over mouth of vessel, 23, or close to mouth if vessel attenuates toward its mouth. The spacer connector, 17, is brought up tightly to the bottom of the vessel, 23, and the legs of the vessel carrier are bent where they emerge below the loops of the spacer connector. The two rubber bands, 19, are bound circumferentially around carrier legs and vessel and the wire, 18, is bound circumferentially around upper parts of carrier legs and vessel. If there are threads in upper part of vessel the wire is run between these threads and ends of wire are twisted till wire is tight.

The vessel, 23 of FIG. 12, is filled with water and suspended from an appropriate link of the chain, 21, by means of the hook, 22, so that mouth of vessel will be a fraction of an inch above water level when lever, 14, is down. When proper adjustment has been made, any one of several water coloring toilet bowl cleansers that are packaged to be removed from wrapper and dropped into toilet tank is placed in the waterfilled, suspended vessel. Chemical-saving, water waste-detecting water treatment can now be started by flipping the lever to up position with tank lid in place, so that mouth of vessel drops below surface of tank water. Thereafter, only the chemical needs be replenished.

What is claimed is:

1. A device for colorimetric detection of a leak past a toilet-tank flush valve and overflow pipe within a toilet flush tank having a lid and an upper rim above a water level and for economizing the dispensing of toilet-bowl cleansing chemicals comprising:

a flexible line having first and second ends means for attaching a source of water coloring toilet bowl cleanser to the first end of said line;

means for slidably mounting said line across said rim of a toilet flush tank such that said first end is disposed within said tank and said second end is disposed exterior to said tank and means associated with said second end for holding said line stationary at a first level whereby said source of water coloring toilet bowl cleanser is above the water level in the tank, and a second level whereby said source of water coloring toilet bowl cleanser is below the water level in the tank without lifting the tank lid.

2. A device as defined in claim 1 wherein said means for attaching a source of water coloring toilet bowl cleanser to said line comprises a water corrosion resistant chain attached to said line and a vessel carrier attached to said chain, said vessel carrier comprising:

water corrosion resistant wire in the form of an inverted "U" having two legs and a cross member having a loop in the center of said cross member;

a water corrosion resistant wire hook mounted in said loop; and a spacer connector holding said legs of said inverted "U" wire form approximately parallel, said spacer connector comprising water corrosion resistant wire with a loop at each end for receiving one leg of said inverted "U" wire form into each loop, said legs being bent where they emerge from said loops;

a vessel for holding said source of water coloring toilet bowl cleanser; and at least one rubber band and a length of corrosion resistant wire disposed around said vessel and vessel carrier for attaching said vessel to said vessel carrier.

3. A device as defined in claim 2 wherein said means for slidably mounting said line comprises:

a rim saddle comprised of a body with three walls forming a U shaped channel sized to fit snugly over the rim of a toilet flush tank having a first leg wall which is disposed on the interior of said flush tank and a second wall adapted to overlie the rim of said flush tank, said second wall having two spacing tabs bent at ½degrees rotation with respect to said second wall and away from the rim of said flush tank for spacing the flush tank cover away from said rim and a third leg wall disposed on the exterior of said flush tank, said third wall having two triangular tabs bent at right angles with respect to said third wall and toward said flush tank, said triangular tabs having two holes;

a lever made of water corrosion resistant wire in the form of a broad "U" and having a cross member connecting two arms, each arm having an end, said ends of said arms are bent toward each other approximately 90 degrees and are sized to snap into said holes of said triangular tabs on said rim saddle said cross member of said lever having a mid section for attachment of said second end of said flexible line.

4. A device as defined in claim 3 wherein said rim saddle is made of sheet metal.

5. A device as defined in claim 4 wherein said rim saddle is made of sheet aluminum, said hook, lever and chain are of stainless steel, said wire in the form of an inverted "U", said spacer connector and said length of corrosion resistant wire are plastic coated, and said line is a fishing line.

6. A device as defined in claim 5 wherein said rim saddle and said lever are painted.

7. A device as defined in claim 3 wherein said rim saddle is made of plastic.

8. A device as described in claim 7 wherein said hook, chain and lever are of stainless steel and, said line is fishing line.

9. A device as defined in claim 8 wherein said plastic rim saddle is a colored and said lever is painted.

* * * * *